United States Patent [19]

Kohl

[11] 4,331,009

[45] May 25, 1982

[54] JACQUARD ATTACHMENT FOR A WARP KNITTING MACHINE

[75] Inventor: Karl Kohl, Obertshausen, Fed. Rep. of Germany

[73] Assignee: Sulzer Brothers Ltd., Winterthur, Switzerland

[21] Appl. No.: 157,088

[22] Filed: Jun. 6, 1980

[30] Foreign Application Priority Data

Jun. 15, 1979 [CH] Switzerland ..... 5615/79

[51] Int. Cl.[3] ..... D04B 23/00; D04B 27/00

[52] U.S. Cl. ..... 66/203; 66/214

[58] Field of Search ..... 66/203, 204, 207, 214

[56] References Cited

U.S. PATENT DOCUMENTS 2,699,658 1/1955 Peters ..... 66/207 X

*Primary Examiner*—Ronald Feldbaum

*Attorney, Agent, or Firm*—Kenyon & Kenyon

[57] ABSTRACT

The jacquard attachment is provided with a guide means having slot-like eyes for guiding the jacquard yarns and a comb above the guide means for reciprocating in the shogging direction to engage selected ones of the jacquard control yarns for movement sideways in the eyes. The eyes are of a width equal to one or more needle spacings to allow movement of the yarns therein.

10 Claims, 8 Drawing Figures

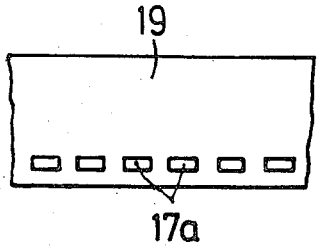
Fig. 7
Fig. 5
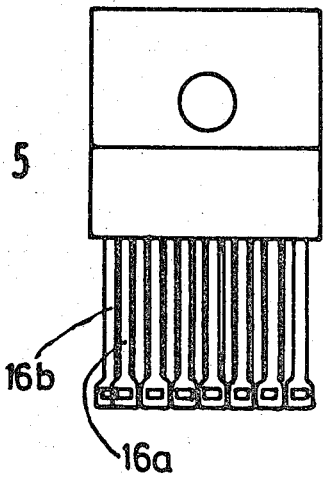
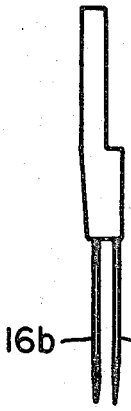
Fig. 6
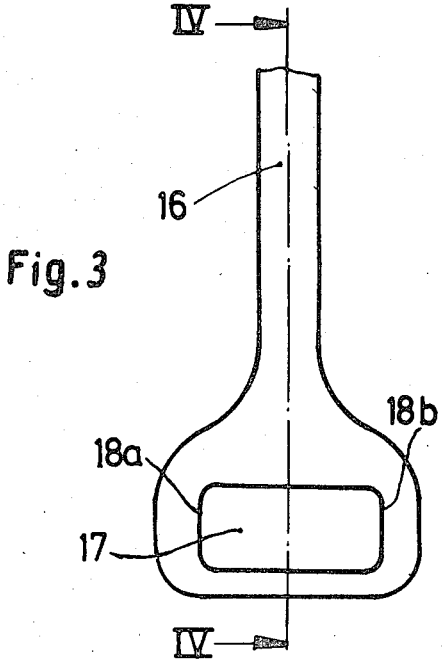
Fig. 3
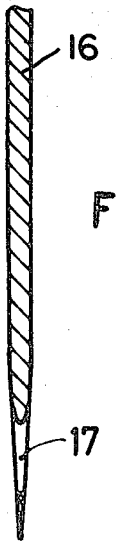
Fig. 4

JACQUARD ATTACHMENT FOR A WARP KNITTING MACHINE

This invention relates to a jacquard attachment for a warp knitting machine.

Heretofore, it has been known to provide warp knitting machines with a jacquard attachment for moving pattern yarns in a shogging direction. In some cases, the jacquard attachment has been constructed to push the selected yarns directly in the shogging direction. Jacquard attachments of this type are generally employed in a crochet and galloon machine, such as described in German Pat. No. 10 67 170. In such cases, jacquard controlled pins are disposed parallel to the crochet needles of the warp knitting machine and are positioned to push the pattern yarns in the shogging direction while a pivotable sinker is employed to press the pushed yarns under the needles. Generally, this type of jacquard attachment is of use only in machines having a course needle spacing as a relatively large number of individual parts are required.

Other jacquard devices have also been known in which a plurality of guides on a guide bar are pushed directly instead of the yarns. In these cases, there are either two adjacent guides in one needle lane or the guides are shaped so that two needles are disposed one behind the other in one plane in a needle lane. In the first case, the jacquard attachment is suitable only for a course needle spacing. In the second case, the jacquard attachment requires two jacquard bars, each with a long stroke.

Accordingly, it is an object of the invention to provide a jacquard attachment for fine needle spacings wherein the pattern yarns can be directly pushed.

It is another object of the invention to provide a jacquard attachment for a warp knitting machine having a fine needle spacing which is of relatively inexpensive construction.

Briefly, the invention provides a jacquard attachment for a warp knitting machine which has a guide means including an array of slot-like eyes for guiding jacquard yarns wherein each eye has a length in a shogging direction equal to one or more needle spacings and a comb disposed above the guide means for reciprocation in the shogging direction in order to engage and move selected ones of the jacquard yarns sideways in the respective eyes.

During operation, the yarns are pushed sideways independently of the width of the needle lane and any knitting elements engaging in the needle lanes. Furthermore, it is much less expensive to provide a comb for moving the yarns than to provide an additional jacquard bar as in previously known devices.

In addition, a chopper bar can be added without difficulty to the jacquard attachment.

The guide means may be in the form of individual guides or a guide strip in which the slot-like eyes are formed. Advantageously, when individual guides are used, two rows of guides are provided one behind the other, the guides being offset from row to row by an amount equal to the needle spacing.

In one embodiment, a jacquard control means having a plurality of movably mounted levers is provided for controlling the jacquard or pattern yarns. In addition, the comb is provided with a plurality of sinkers for engaging selected ones of the jacquard yarns with selected ones of the levers being movable into positions between the sinkers of the comb.

If two or more pattern yarns are laid in a needle lane, the yarn eyes may guide two or more jacquard yarns with each being controlled in a different way from the other by the jacquard control means.

These and other objects and advantages of the invention will become more apparent from the following detailed description and appended claims taken in conjunction with the accompanying drawings in which:

FIG. 3 illustrates a portion of a guide of a guide means according to the invention;

FIG. 4 illustrates a view taken on line IV—IV of FIG. 3;

FIG. 5 illustrates a modified guide means having two rows of guides in accordance with the invention;

FIG. 6 illustrates a side view of the guide means of FIG. 5;

FIG. 7 illustrates a portion of a guide strip constructed in accordance with the invention.

Figure 1:
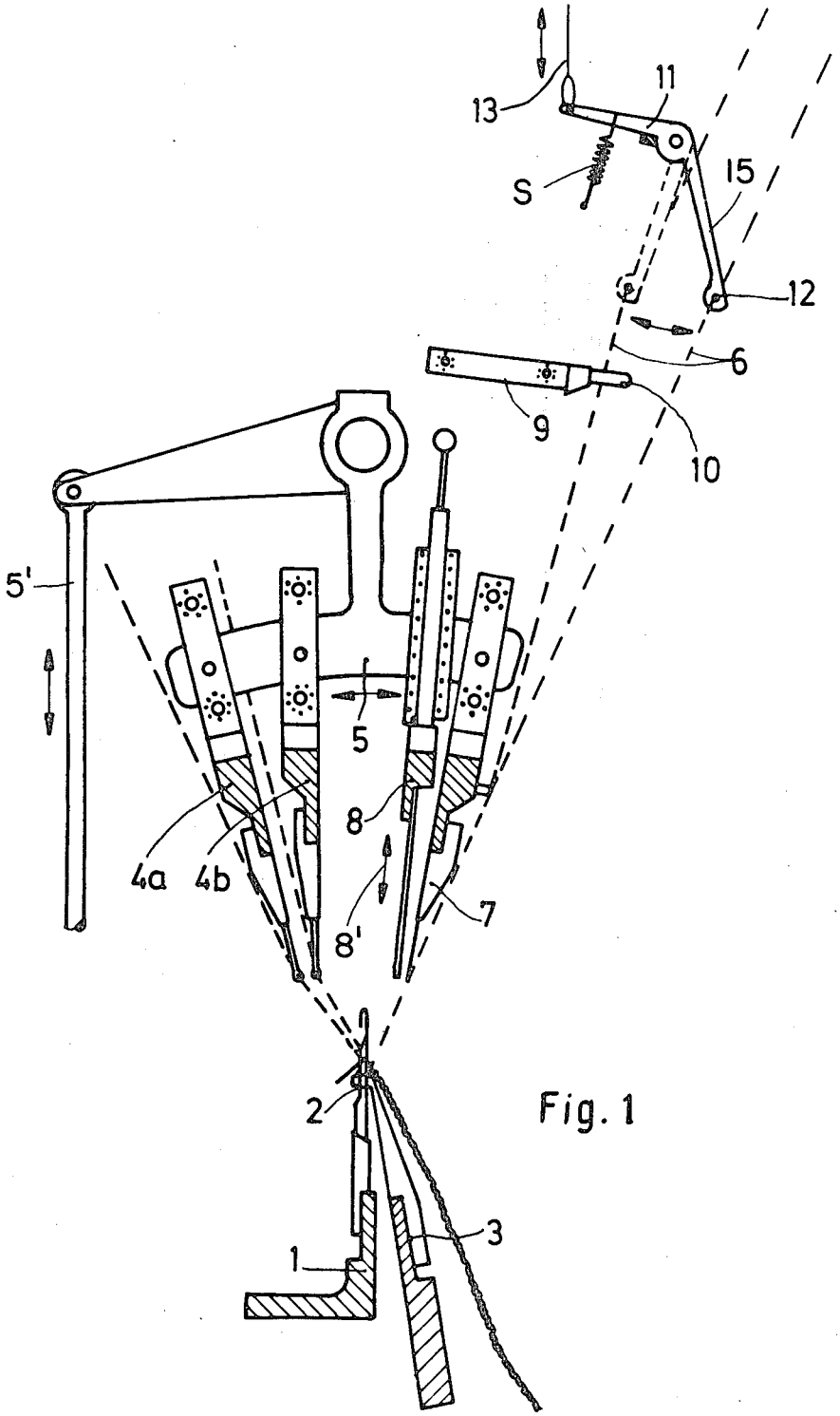
FIG. 1 illustrates a sectional view through a warp knitting machine having a jacquard attachment in accordance with the invention.

Referring to FIG. 1, the warp knitting machine is of generally known construction and has a vertically reciprocating needle bar 1 with a plurality of latch needles 2 mounted thereon. In addition, the machine has a comb plate 3 cooperating with the needles 2 at a stitch forming place. Also, a pair of base guide bars 4*a*, 4*b* are mounted over the knitting place via a suspension means 5 which is controlled via a cam rod 5' in known manner. In addition, a guide means 7 is mounted on the suspension means 5 in order to guide a plurality of jacquard yarns 6 in known manner to the stitch-forming place. A chopper bar 8 is also mounted on the suspension means 5 behind the guide means 7 and is operable as indicated by the arrow 8' in known manner.

The guide means 7 is constructed of a single row of guides 16 (see FIG. 3) each of which has a slot-like eye 17 for guiding a jacquard yarn 6 therethrough. As shown in FIG. 3, each eye 17 is of rectangular shape and is bounded by a pair of spaced apart parallel edges 18*a*, 18*b*. Each eye 17 has a length in the shogging direction equal to one or more needle spacings i.e. the spacing of the needles 2 on the needle bar 1.

Referring to FIG. 1, the warp knitting machine also has a comb 9 disposed above the guide means 7 for reciprocation in the shogging direction in order to engage and move selected ones of the jacquard yarns sideways in the eyes 17. The comb 9 constantly reciprocates in time with the machine and has a plurality of sinkers 10 for engaging selected ones of the jacquard yarns 6.

In addition, a jacquard control means is positioned above the comb 9 for selecting the yarns 6 to be moved by the comb 9. To this end, the jacquard control means has a plurality of pivotally mounted levers 11 each having an arm 15 with an eye 12 through which a respective jacquard yarn 6 is guided. Each lever 11 is biased by a spring S counter-clockwise, as viewed, and is connected to a harness cord 13 which extends to a suitable control box (not shown) of the control means. Each lever 11 is controlled to move clockwise, as viewed, from one position, as shown, under the influence of the harness cord 13 against the influence of the spring S into the illustrated dotted line position. The levers 11 are positioned relative to the comb 9 so that upon movement of a lever 11 into the dotted line position shown, the arm 15 of the lever 11 is disposed between a pair of sinkers 10 of the comb 9. This position is not illustrated in the drawings for the sake of simplicity.

Figure 2:
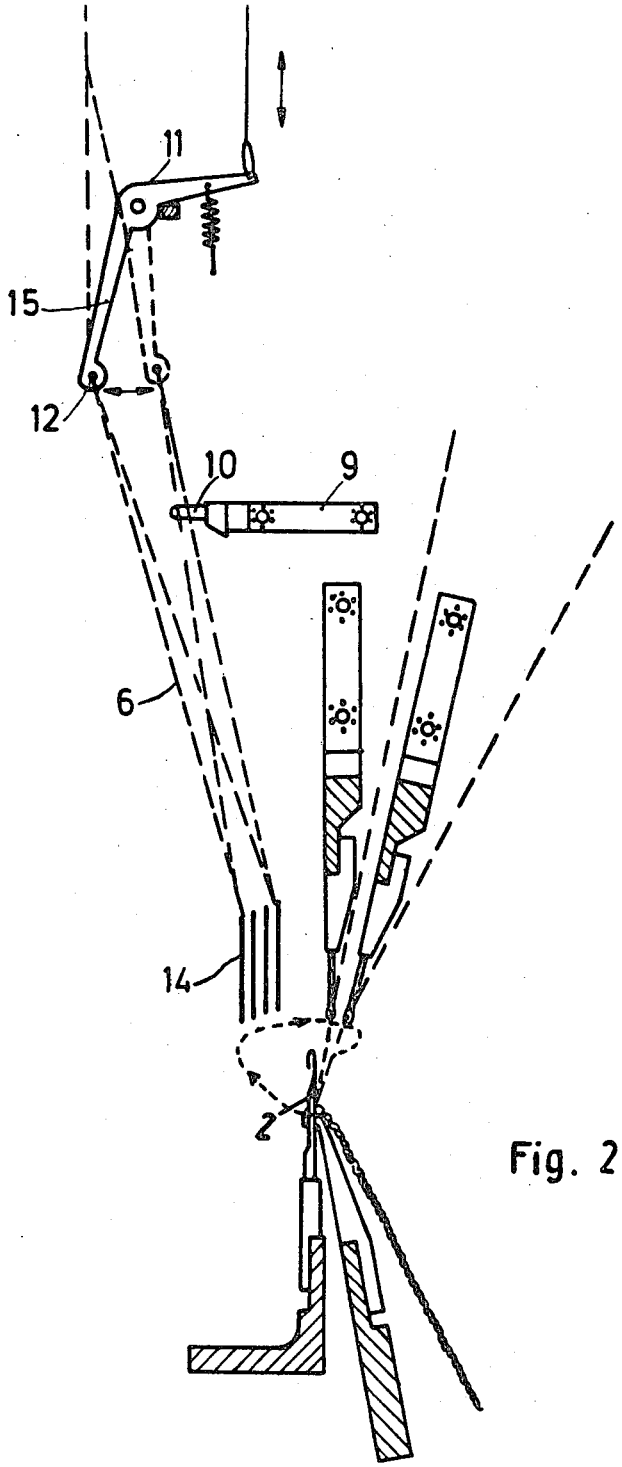
FIG. 2 illustrates a view similar to FIG. 1 of a modified jacquard attachment according to the invention.

Referring to FIG. 2 wherein like reference characters indicate like parts as above, the guide means may be in the form of a plurality of guide strips 14 to which the jacquard yarns 6 are supplied via the levers 11. In this embodiment, as shown in FIG. 7, each guide strip 19 is provided with a row of slot-shaped eyes 17*a*.

Referring to FIGS. 5 and 6, the guide means may alternatively be constructed with a pair of rows of guides 16*a*, 16*b*. In this case, the rows are disposed one behind the other and are offset from each other by an amount equal to the needle spacing.

In each embodiment, the eye for guiding a jacquard yarn is of a width sufficient to allow a pattern yarn 6 to be moved sideways in the shogging direction in order to carry out a lap on a respective needle 2.

Figure 8:
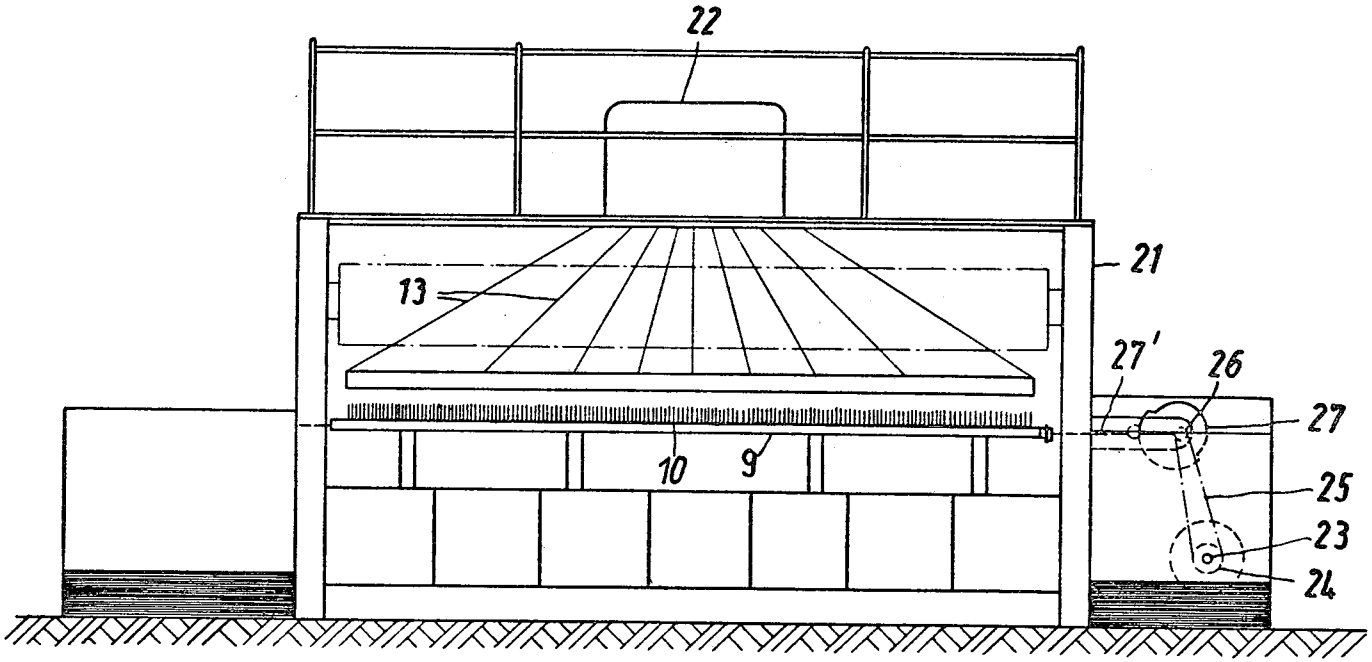
FIG. 8 illustrates a view of a warp knitting machine having a drive for moving the comb in the shogging direction in accordance with the invention.

Referring to FIG. 8, a suitable means is provided for reciprocating the comb 9 in a shogging direction in timed relation to the warp knitting machine. As shown, the machine includes a frame 21 on which a jacquard machine 22 is mounted. The harness cords 13 extend from the machine 22 to the various levers 11 (not shown). The comb 9 is mounted so as to be movable in the longitudinal direction of the machine and is driven in the shogging direction by a shaft 23 which is driven off the main shaft (not shown) of the machine by a bevelled gearing (not shown). The main shaft, for example, extends in the longitudinal direction of the machine. The shaft 23 carries a sprocket 24 which drives a cam 27 via a chain 25 and a second sprocket 26. The cam 27, in turn, controls the longitudinal motion of the comb 9 via a push rod 27' and is suitably shaped for this purpose. Suitable bore and socket joints are also provided so that the longitudinal motion can be superimposed on the oscillation, if any, of the comb 9. If required, additional pivoting motion at an angle to the yarns 6 (FIG. 1) can be superimposed on the comb 9 to facilitate penetration of the sinkers 10 into the yarns 6 controlled by the levers 11.

During operation, selected jacquard yarns 6 are moved by the levers 11 into the spaces between the sinkers 10 of the reciprocating comb 9 and, upon movement of the comb 9, are shifted in the shogging direction. These yarns 6 are also shifted within the eyes 17 of the guide means 7 to permit a lapping operation to be carried out in known manner.

It is to be noted that two jacquard yarns may be passed through a single eye 17 with each being separably controlled by a lever 11 of the jacquard control means.

The invention thus provides a jacquard attachment which can be used with fine needle spacings without increasing the cost of the attachment.

What is claimed is:

1. A jacquard attachment for a warp knitting machine, said attachment comprising guide means including an array of slot-like eyes for guiding jacquard yarns therein, each said eye having a length in a shogging direction equal to one or more needle spacings; and a comb disposed above said guide means for reciprocation in said shogging direction to engage and move selected ones of the jacquard yarns sideways in said eyes.

2. A jacquard attachment as set forth in claim 1 wherein said guide means has a plurality of guides, each said guide having a respective eye therein of rectangular shape extending in said shogging direction

3. A jacquard attachment as set forth in claim 2 wherein said guides are disposed in two rows with said guides in one row being offset from said guides in the other row a distance equal to a needle spacing.

4. A jacquard attachment as set forth in claim 1 wherein said guide means has a plurality of guide strips disposed in closely spaced parallel relation, each said strip having a plurality of said eyes therein.

5. A jacquard attachment as set forth in claim 1 which further includes a jacquard control means having a plurality of pivotally mounted levers above said comb, each said lever having an eye for guiding a jacquard yarn therethrough and being selectively pivotal between a first position and a second position wherein in said second position, said comb engages the yarn passing through said lever.

6. A jacquard attachment as set forth in claim 5 wherein said comb includes a plurality of sinkers and each said lever is disposed between a pair of said sinkers in said second position thereof and in spaced relation to said comb in said first position thereof.

7. A jacquard attachment as set forth in claim 5 wherein each eye of said guide means has two yarns passing therethrough from a respective pair of eyes of said levers.

8. In a warp knitting machine, the combination including a needle bar having a plurality of needles thereon disposed in spaced apart relation;

a guide means above said needle bar for guiding jacquard yarns to said needles, said guide means including an array of slot-like eyes for guiding jacquard yarns therein, each said eye having a length in a shogging direction equal to one or more needle spacings; and a jacquard control means having a plurality of movably mounted levers, each said lever having an eye for guiding a jacquard yarn therethrough towards said needle bar and being selectively movable between a first position and a second position; and a comb disposed above said guide means and below said levers for reciprocation in said shogging direction, said comb having a plurality of sinkers for engaging selected ones of the jacquard yarns with selected ones of said levers in said second positions thereof to move the selected jacquard yarns in said shogging direction and sideways in respective eyes of said guide means.

9. The combination as set forth in claim 8 wherein each said lever is disposed between a pair of said sinkers in said second position thereof and in spaced relation to said comb in said first position thereof.

10. The combination as set forth in claim 8 which further includes manes for reciprocating said comb in said shogging direction in timed relation.

* * * * *